US009607560B2

(12) United States Patent
Kim et al.

(10) Patent No.: US 9,607,560 B2
(45) Date of Patent: Mar. 28, 2017

(54) LIQUID CRYSTAL DISPLAY DEVICE AND METHOD FOR DRIVING THE SAME

(71) Applicant: LG Display Co., Ltd., Seoul (KR)

(72) Inventors: SunUng Kim, Mokpo-si (KR); JungSik Park, Daegu (KR); JunHo Yoo, Namwon-si (KR); JaeHoon Park, Busan (KR)

(73) Assignee: LG DISPLAY CO., LTD., Seoul (KR)

( * ) Notice: Subject to any disclaimer, the term of this patent is extended or adjusted under 35 U.S.C. 154(b) by 168 days.

(21) Appl. No.: 13/720,970

(22) Filed: Dec. 19, 2012

(65) Prior Publication Data

US 2014/0062983 A1 Mar. 6, 2014

(30) Foreign Application Priority Data

Aug. 31, 2012 (KR) ..... 10-2012-0096229

(51) Int. Cl.
*G09G 3/36* (2006.01)
*G09G 3/20* (2006.01)

(52) U.S. Cl.
CPC ..... *G09G 3/3611* (2013.01); *G09G 3/2092* (2013.01); *G09G 3/3696* (2013.01); *G09G 3/3688* (2013.01); *G09G 2370/08* (2013.01); *G09G 2370/14* (2013.01)

(58) Field of Classification Search
CPC .. G09G 3/2092; G09G 3/3611; G09G 3/3696; G09G 2370/08; G09G 2370/14; G09G 3/3688
See application file for complete search history.

(56) References Cited

U.S. PATENT DOCUMENTS

| | | | | |
|---|---|---|---|---|
| 6,697,040 | B2 * | 2/2004 | Imajo et al. | 345/98 |
| 2001/0013850 | A1 * | 8/2001 | Sakaguchi et al. | 345/87 |
| 2006/0187159 | A1 | 8/2006 | Nakano et al. | |
| 2006/0202937 | A1 * | 9/2006 | Chen et al. | 345/100 |
| 2006/0232579 | A1 | 10/2006 | Chen et al. | |
| 2007/0052651 | A1 | 3/2007 | Kim et al. | |
| 2010/0283777 | A1 | 11/2010 | Sang et al. | |
| 2011/0102687 | A1 | 5/2011 | Ko et al. | |
| 2011/0157103 | A1 | 6/2011 | Chen et al. | |
| 2011/0298812 | A1 * | 12/2011 | Liu et al. | 345/502 |
| 2012/0014080 | A1 * | 1/2012 | Feng et al. | 361/784 |
| 2013/0286056 | A1 | 10/2013 | Chen | |
| 2014/0137065 | A1 | 5/2014 | Feng et al. | |

FOREIGN PATENT DOCUMENTS

| | | | |
|---|---|---|---|
| CN | 1299982 | A | 6/2001 |
| CN | 1928979 | A | 3/2007 |
| CN | 101887699 | A | 11/2010 |
| CN | 102084286 | A | 6/2011 |
| CN | 102110404 | A | 6/2011 |
| CN | 102340923 | A | 2/2012 |
| CN | 102402089 | A | 4/2012 |
| CN | 102637419 | A | 8/2012 |
| WO | WO 2013/159320 | A1 | 10/2013 |

* cited by examiner

*Primary Examiner* — Nicholas Lee
*Assistant Examiner* — Richard Hong
(74) *Attorney, Agent, or Firm* — Birch, Stewart, Kolasch & Birch, LLP

(57) ABSTRACT

Discussed are an LCD device and a method of driving the same in which, by decreasing the number of lines of a PCB, the manufacturing cost is saved, and the influence of noise is reduced.

13 Claims, 10 Drawing Sheets

FIG. 3
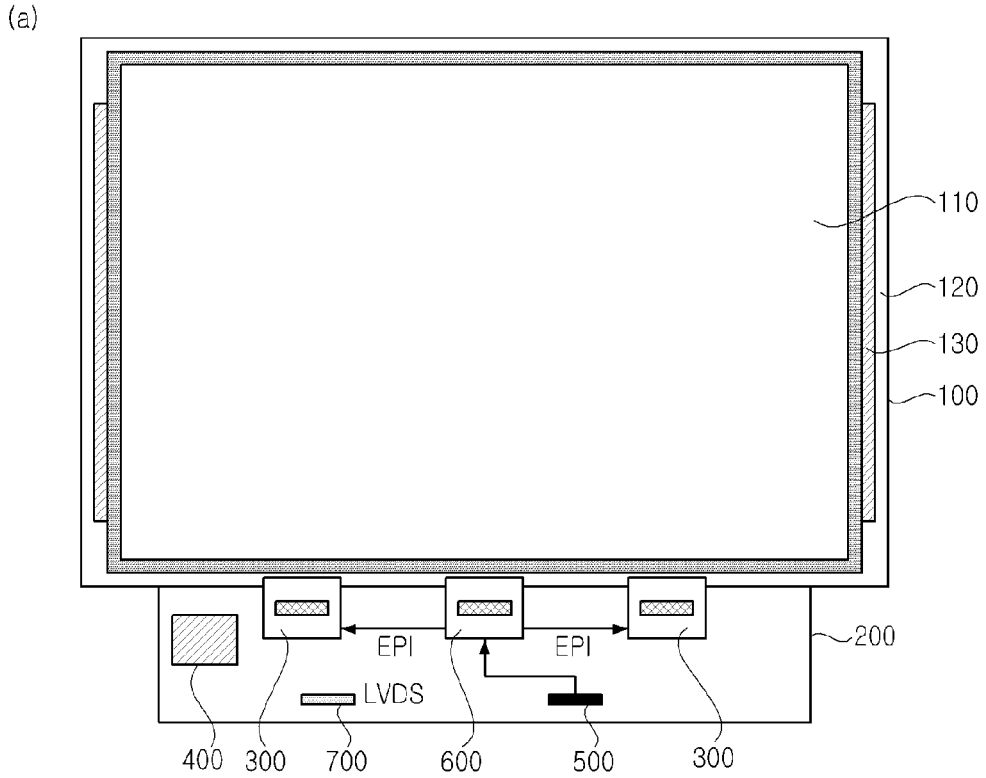
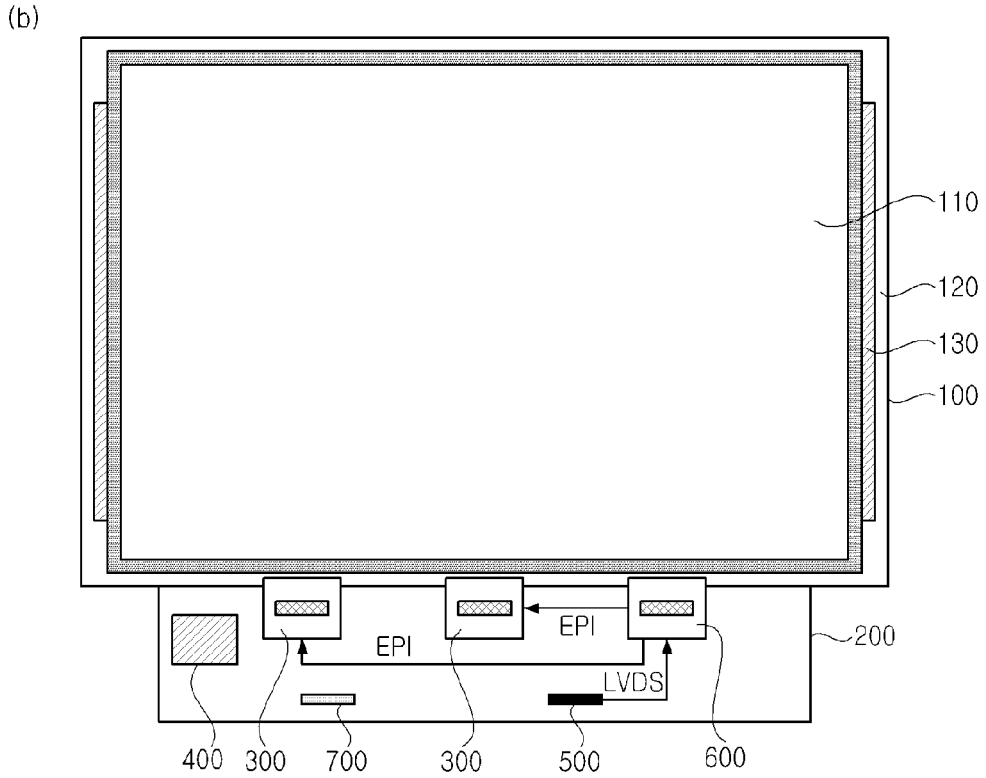

FIG. 9

| Control data | name | bit | description |
|---|---|---|---|
| CTR_start | indicator | C[5:0] | Control packet start indicator(LSB→MSB) |
| | dummy | C[17:6] | |
| CTR1 | SOE start | C[7:0] | |
| | SOE width | C[17:8] | |
| CTR2 | POL | C0 | Polarity inversion |
| | MODE | C1 | Fixed to Low |
| | H2DOT | C2 | Horizontal 2 Dot inversion |
| | LTD1 | C3 | Low temperature drive model selection |
| | LTD2 | C4 | |
| | PWRC1 | C5 | Output buffer power control |
| | PWRC2 | C6 | |
| | PWRC3 | C7 | |
| | dummy | C8 | |
| | GSP | C9 | Gate start pulse to indicate frame start time |
| | CSC | C10 | Change share mode control |
| | GMAENB1 | C10 | Gamma buffer enable |
| | GMAENB2 | C10 | |
| | POLC | C10 | Polarity control |
| | Reserved | C10 | |
| | Reserved | C10 | |
| | Reserved | C10 | |
| | Reserved | C10 | |
| Data_start | indicator | C[5:0] | Data packet start indicator(LSB→MSB) |
| | dummy | C[17:6] | |

FIG. 10

<packet gamma data>

| | | | |
|---|---|---|---|
| packet gamma data | GMA1 | G1[3:0] | Gamma #1 Voltage control |
| | GMA2 | G2[3:0] | Gamma #2 Voltage control |
| | GMA3 | G3[3:0] | Gamma #3 Voltage control |
| | GMA4 | G4[3:0] | Gamma #4 Voltage control |
| | GMA5 | G5[3:0] | Gamma #5 Voltage control |
| | GMA6 | G6[3:0] | Gamma #6 Voltage control |
| | GMA7 | G7[3:0] | Gamma #7 Voltage control |
| | GMA8 | G8[3:0] | Gamma #8 Voltage control |
| | GMA9 | G9[3:0] | Gamma #9 Voltage control |
| | GMA10 | G10[3:0] | Gamma #10 Voltage control |

LIQUID CRYSTAL DISPLAY DEVICE AND METHOD FOR DRIVING THE SAME

CROSS-REFERENCE TO RELATED APPLICATIONS

This application claims the priority benefit of the Korean Patent Application No. 10-2012-0096229 filed on Aug. 31, 2012, which is hereby incorporated by reference as if fully set forth herein.

BACKGROUND

Field of the Invention

The present invention relates to a liquid crystal display (LCD) device, and more particularly, to an LCD device and a method of driving the same in which, by decreasing the number of lines of a printed circuit board (PCB), the manufacturing cost is saved, and the influence of noise is reduced.

Discussion of the Related Art

In LCD devices, manufacturing technology is advanced, the drivability of a driving means is good, low power is consumed, high-quality images are realized, and a large screen is realized. Therefore, LCD devices are being popularized. Also, LCD devices are being applied to various fields such as portable computers including notebook computers, office automation equipment, portable multimedia equipment, indoor/outdoor display devices, etc., and the application fields of LCD devices are continuously expanding.

FIG. 1 is a diagram schematically illustrating a related art LCD device. FIG. 2 is a diagram illustrating a connection structure between a connector and a plurality of timing controller merged integrated circuits (TMICs) mounted on a related art PCB.

Referring to FIGS. 1 and 2, the related art LCD device includes a liquid crystal panel 10 that displays an image, a backlight unit (not shown) that supplies light to the liquid crystal panel 10, and a driving circuit part that drives the liquid crystal panel 10.

The liquid crystal panel 10 includes an upper substrate (color filter array substrate), a lower substrate (thin film transistor (TFT) array substrate), and a liquid crystal layer formed between the upper substrate and the lower substrate. The liquid crystal panel 10 includes a plurality of pixels that are arranged in a matrix type, and adjusts the transmittance of light irradiated from the backlight unit to display an image.

The driving circuit part includes a gate driver 15, a plurality of TMICs 30, and a power supply (PMIC) 40. Here, the TMICs 30 and the power supply are mounted on the PCB 20.

A connector and a plurality of lines 60 for transferring external input signals to the TMICs 30 are formed in the PCB 20. Also, an electrically erasable programmable read-only memory (EEPROM) 70, which stores control data for driving the TMICs 30 and generating gamma voltages, is disposed in the PCB 20.

The gate driver 15 is formed in a gate-in panel (GIP) type in an inactive area of the liquid crystal panel 10, and sequentially supplies a scan signal to a plurality of gate lines formed in the liquid crystal panel 10.

Image signals and a control signal (including a timing signal) are inputted as low voltage differential signals (LVDSs) to the connector 50, and the LVDSs are supplied to the TMICs 30 through the lines 60 connected to the connector 50. In this case, the LVDSs inputted to the connector 50 are supplied to the TMICs 30 in a multi-drop type.

The TMICs 30 include a timing controller and a data driver. The TMICs 30 generate a control signal for controlling the gate driver 15 to supply the control signal to the gate driver 15, and generate a control signal for controlling the data driver to supply the control signal to the data driver 15. Also, the data driver provided in the TMICs 30 generates analog data voltages according to image signals included in the input LVDSs, and supply the respective data voltages to a plurality of data lines formed in the liquid crystal panel 10.

Since the related art LCD device having the above-described configuration applies the TMICs 30 for supplying data voltages to respective pixels of the liquid crystal panel 10, the manufacturing cost increases.

When the liquid crystal panel 10 has a 15.6 inches size screen, three TMICs 30 are applied to an LCD device, but, the three TMICs 30 are applied to one liquid crystal module (LCD), causing the reduction in price competitiveness.

Moreover, since the plurality of lines 60 are formed in the PCB 20 in order to supply the LVDSs to the TMICs 30, the area of the PCB 20 increases. Recently, research is conducted for reducing the area of the PCB 20 on which the driving circuit part of an LCD device is mounted, but, due to the plurality of lines 60 formed in the PCB 20, there is a limitation in reducing the area of the PCB 20.

Moreover, when three TMICs 30 are mounted on the PCB 20, a plurality of the lines 60 should be formed in the PCB 20 so as to respectively supply LVDSs to the three TMICs 30. In order to form a plurality of lines in a small area, an expensive build-up PCB is applied to an LCD device, causing the increase in the manufacturing cost of the LCD device.

SUMMARY

Accordingly, the present invention is directed to an LCD device and a method of driving the same that substantially obviate one or more problems due to limitations and disadvantages of the related art.

An aspect of the present invention is directed to an LCD device and a method of driving the same that can reduce the manufacturing cost increased by to a plurality of TMICs.

Another aspect of the present invention is directed to an LCD device in which, by replacing an expensive build-up PCB (on which a driving circuit part is mounted) with an inexpensive multi-layer board (MLB) PCB, the manufacturing cost can be saved.

Another aspect of the present invention is directed to an LCD device for reducing the area of a PCB with a driving circuit part mounted thereon.

Another aspect of the present invention is directed to an LCD device for reducing the number of lines that supply LVDSs to a TMIC mounted on a PCB.

Another aspect of the present invention is directed to an LCD device and a method of driving the same in which, by mounting a gamma voltage generator on a data driver, the manufacturing cost can be saved.

In addition to the aforesaid objects of the present invention, other features and advantages of the present invention will be described below, but will be clearly understood by those skilled in the art from descriptions below.

Additional advantages and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these and other advantages and in accordance with the purpose of the invention, as embodied and broadly described herein, there is provided an LCD device including: a liquid crystal panel; a gate driver formed in an inactive area of the liquid crystal panel; and a PCB, a TMIC with a timing controller and data driver merged therein, a plurality of data drivers that are driven with packet data supplied from the TMIC, and a power supply being mounted on the PCB.

In another aspect of the present invention, there is provided a method of driving an LCD device, in which a single TMIC and a plurality of data drivers are mounted on a PCB, including: inputting an image signal and a control signal to the TMIC in an LVDS interface type; generating, by each of the data drivers included in the TMIC, a data voltage supplied to a liquid crystal panel on the basis of the image signal and the control signal; converting, by the TMIC, the image signal and the control signal into packet data, and supplying the packet data to the data drivers; and generating a data voltage supplied to the liquid crystal panel on the basis of the packet data inputted from the data drivers.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings:

FIG. 3 is a diagram illustrating an LCD device according to an embodiment of the present invention;

FIGS. 8 and 9 are for describing a driving method according to an embodiment of the present invention, and are diagrams illustrating an EPI packet transferred from the TMIC to the data driver; and FIG. 10 is a diagram illustrating packet gamma data applied to the driving method according to an embodiment of the present invention.

DETAILED DESCRIPTION OF THE INVENTION

Reference will now be made in detail to the exemplary embodiments of the present invention, examples of which are illustrated in the accompanying drawings. Wherever possible, the same reference numbers will be used throughout the drawings to refer to the same or like parts.

Hereinafter, an LCD device and a method of driving the same according to embodiments of the present invention will be described in detail with reference to the accompanying drawings.

LCD devices have been variously developed in a twisted nematci (TN) mode, a vertical alignment (VA) mode, an in-plane switching (IPS) mode, and a fringe field switching (FFS) mode according to a scheme of adjusting the alignment of liquid crystal. An LCD device according to an embodiment of the present invention may be unrestrictedly applied to all driving modes as well as the TN mode, the VA mode, the IPS mode, and the FFS mode.

Figure 1:
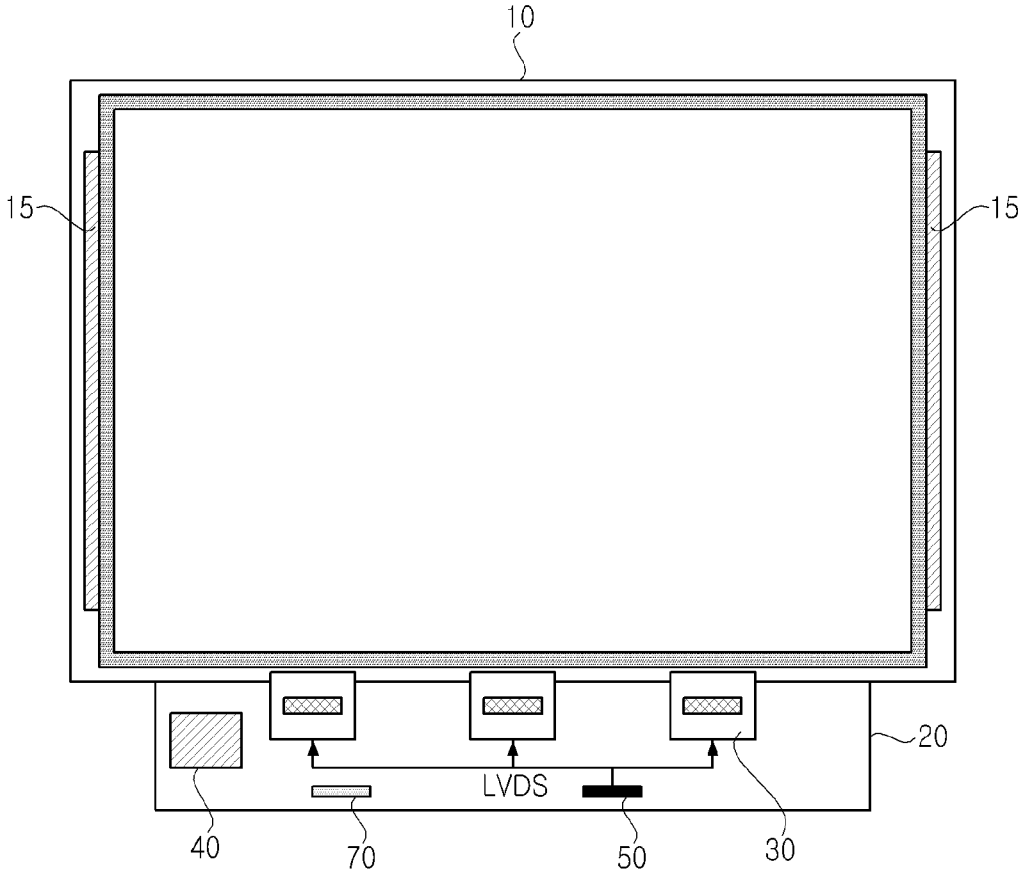
FIG. 1 [ Related Art ]
FIG. 1 is a diagram schematically illustrating a related art LCD device.
Figure 2:
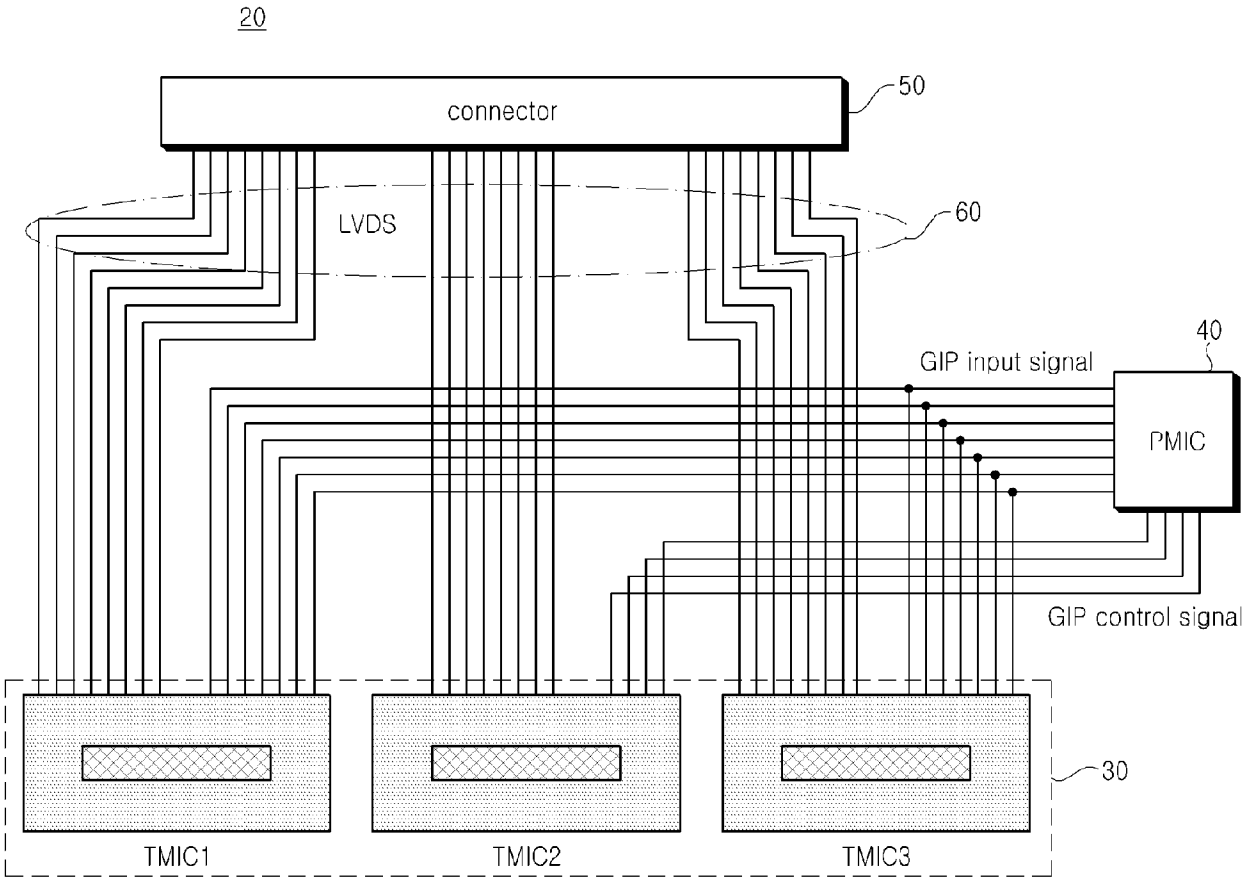
FIG. 2 [ Related Art ]
FIG. 2 is a diagram illustrating a connection structure between a connector and a plurality of TMICs mounted on a related art PCB.
Figure 4:
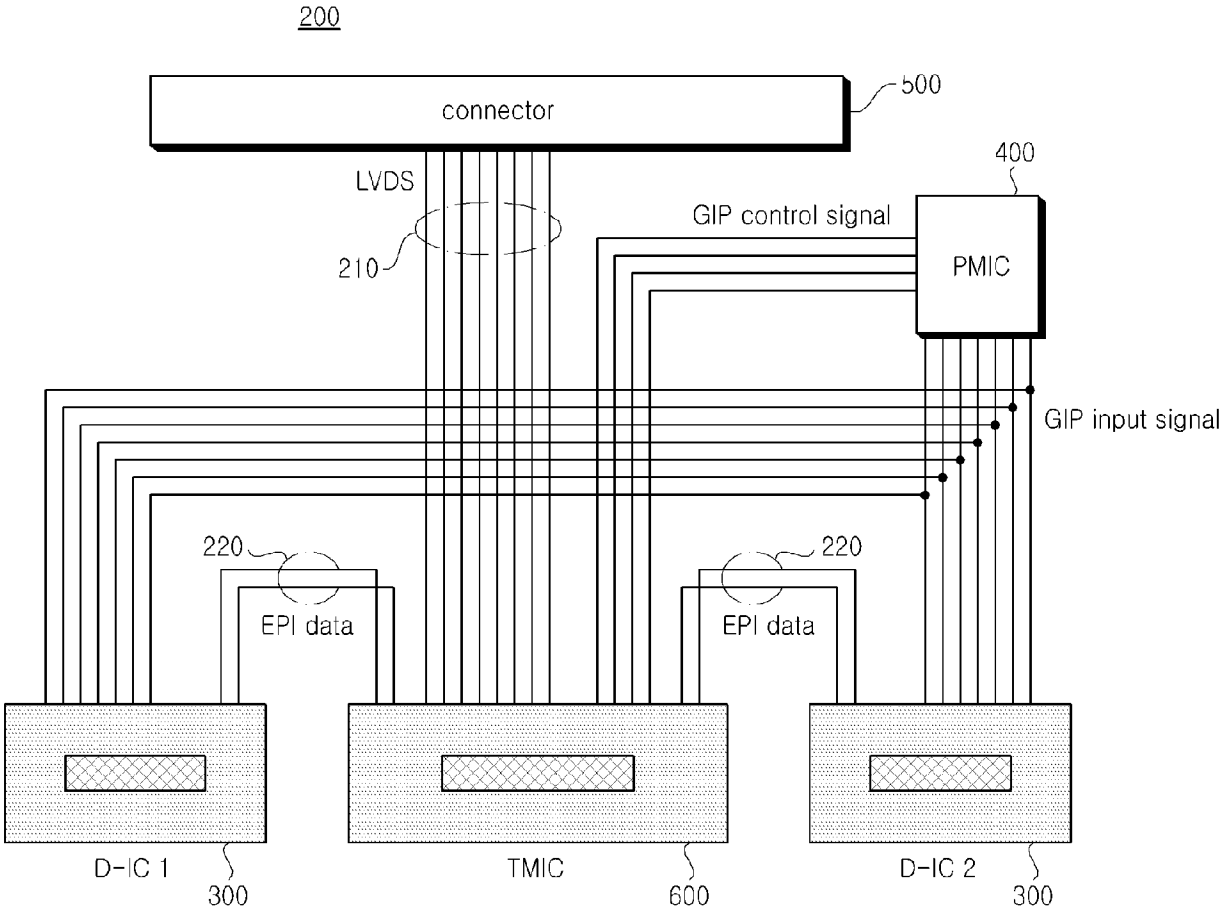
FIG. 4 is a diagram illustrating a connection structure of a TMIC, a data driver, and a connector that are mounted on a PCB.

FIG. 3 is a diagram illustrating an LCD device according to an embodiment of the present invention. FIG. 4 is a diagram illustrating a connection structure of a TMIC, a data driver, and a connector that are mounted on a PCB.

Referring to FIGS. 3 and 4, the LCD device according to an embodiment of the present invention includes a liquid crystal panel 100 that displays an image, a backlight unit (not shown) that supplies light to the liquid crystal panel 100, and a driving circuit part.

The liquid crystal panel 100 includes an upper substrate (color filter array substrate), a lower substrate (thin film transistor (TFT) array substrate), and a liquid crystal layer formed between the upper substrate and the lower substrate. A plurality of gate lines and a plurality of data lines are formed to intersect in the lower substrate of the liquid crystal panel 100, and a plurality of pixels are defined by intersections between the gate lines and the data lines. The pixels are arranged in a matrix type. Each of the pixels includes a TFT that is a switching element, a storage capacitor, a pixel electrode, and a common electrode.

When the liquid crystal panel 100 displays an image with vertical electric fields as in the TN mode and the VA mode, the common electrode is formed in the upper substrate.

When the liquid crystal panel 100 displays an image with lateral electric fields as in the IPS mode or the FFS mode, the common electrode is formed in the lower substrate.

Liquid crystal is aligned with an electric field generated by a voltage difference between a data voltage supplied to a pixel and a common voltage supplied to a common electrode to adjust transmittance of light irradiated from the backlight unit, thereby displaying an image.

The backlight unit includes a light source that generates light supplied to the liquid crystal panel 100, and a plurality of optical members for enhancing light efficiency. The light source may use a cold cathode fluorescent lamp (CCFL), an external electrode fluorescent lamp (EEFL), or a light emitting diode (LED). The optical members may include a light guide panel (LGP), a diffusive film, a prism sheet, and a dual brightness enhancement film (DBEF).

The driving circuit part includes a gate driver 130, a plurality of data drivers 300, a power supply (PMIC) 400, and a single TMIC 600.

In FIG. 3, it is illustrated as an example that the single TMIC 600 and two data drivers 300 are mounted on the PCB 200, and, as a screen size of the liquid crystal panel 100 increases, the number of data drivers 300 may also increase in proportion to the screen size. The TMIC 600 may be disposed between the two data drivers 300, or disposed in one side of the PCB 200.

In the LCD device of the present invention, irrespective of the position of the TMIC 600, the single TMIC 600 generates an embedded point to point interface packet (EPI)

packet, and supplies the EPI packet to the data drivers 600, thereby enabling the liquid crystal panel 100 to display an image. Accordingly, the number of TMICs can be considerably reduced compared to the related art LCD device.

The liquid crystal panel 100 includes an active area 110 for displaying an image, and an inactive area 120 in which a plurality of lines and a plurality of pads are formed. In the driving circuit part, the gate driver 130 may be formed in a GIP type in the inactive area 120.

The gate driver 130 generates a scan signal with a GIP control signal (supplied from the TMIC 600) and a GIP input signal supplied from the power supply 400. Subsequently, the gate driver 130 sequentially supplies the scan signal to the gate lines formed in the liquid crystal panel 100, and switches on the pixels formed in the liquid crystal panel 100.

The TMIC 600, the data drivers 300, and the power supply 400 are mounted on the PCB 200. A connector 500 for transferring an external input LVDS to the TMIC 600 is formed in the PCB 200. Also, an EEPROM 700 that stores control data for driving the TMIC 600 and generating gamma voltages is disposed in the PCB 20.

A plurality of first lines (LVDS lines) 210 for connecting the connector 500 and the TMIC 600 are formed in the PCB 120, and a plurality of second lines (EPI packet lines) 220 for connecting the TMIC 600 and the data drivers 300 are formed in the PCB 120.

A plurality of LVDSs including an image signal and a control signal are inputted to the connector 500, and inputted to the TMIC 600 via the first lines 210. A plurality of EPI packets generated by the TMIC 600 are supplied to the data drivers 300 via the second lines 220.

In the above description and the drawings, it has been described that an image signal and a control signal are inputted to the TMIC 600 in an LVDS interface type. However, this is to describe one of various embodiments. In another embodiment of the present invention, an image signal and a control signal may be inputted to the TMIC 600 in an advanced intra panel interface (AiPi) type, a mobile industry processor interface (MIPI) type, or an embedded display port (eDP) interface type.

Figure 5:
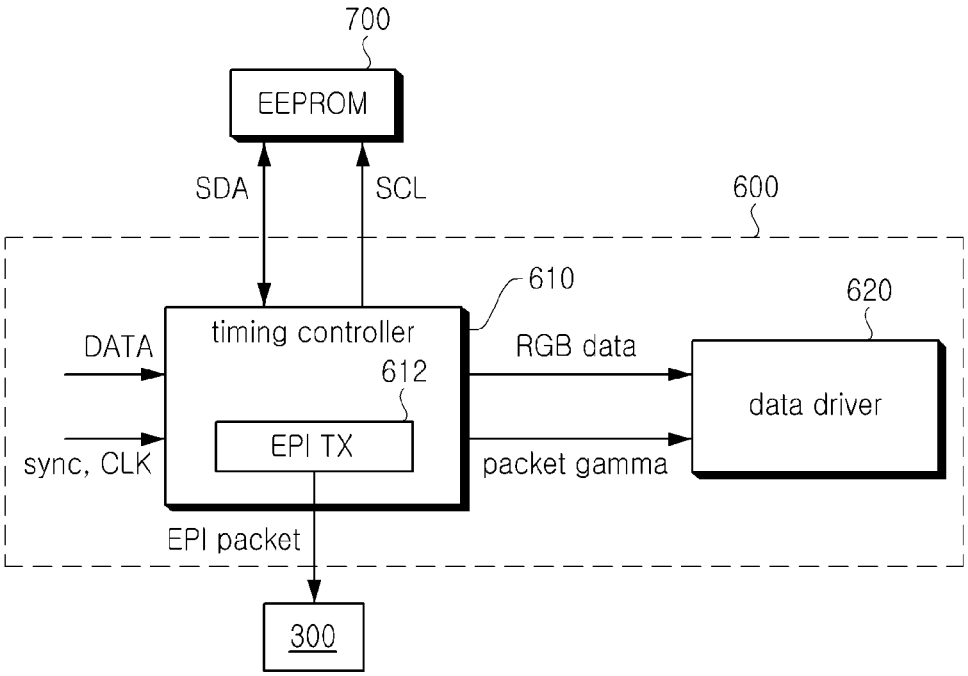
FIG. 5 is a diagram illustrating a configuration of the TMIC according to an embodiment of the present invention.

FIG. 5 is a diagram illustrating a configuration of the TMIC.

Referring to FIG. 5, the TMIC 600 is implemented by merging a timing controller 610 and a data driver 620. The TMIC 600 is connected to the EEPROM 700 that is a memory element, and driven by loading a control signal for driving the TMIC 600 and gamma control data for controlling gamma voltages from the EEPROM 700.

The timing controller 610 included in the TMIC 600 generates an EPI packet. The data driver 620 included in the TMIC 600 generates a data voltage supplied to a data line formed in the liquid crystal panel 100. In this case, the data driver 620 included in the TMIC 600 generates data voltages supplied to some (for example, one-third of all data lines) of all data lines.

The timing controller 610 included in the TMIC 600 converts an image signal and a control signal, which are included in an LVDS, into an EPI packet.

The TMIC 600 includes an EPI output unit (EPI TX) 630 for supplying EPI packets to a plurality of data drivers 300, and supplies the EPI packets to the data drivers 300 in a point-to-point type through the second lines 220 connected to the EPI output unit 630.

In the above description and the drawing, it has been described that an image signal and a control signal are supplied from the single TMIC 600 to the data drivers 300 in an EPI interface type. However, this is to describe one of various embodiments. In another embodiment of the present invention, an image signal and a control signal may be inputted from the single TMIC 600 to the data drivers 300 in an advanced voltage differential signaling (AVDS) interface type, an advanced current differential signaling (ACDS) interface type, a reduced swing differential signaling (RSDS) interface type, a transistor-transistor logic (TTL) interface type, or an enhanced reduced swing differential signaling (eRVDS) interface type.

Figure 6:
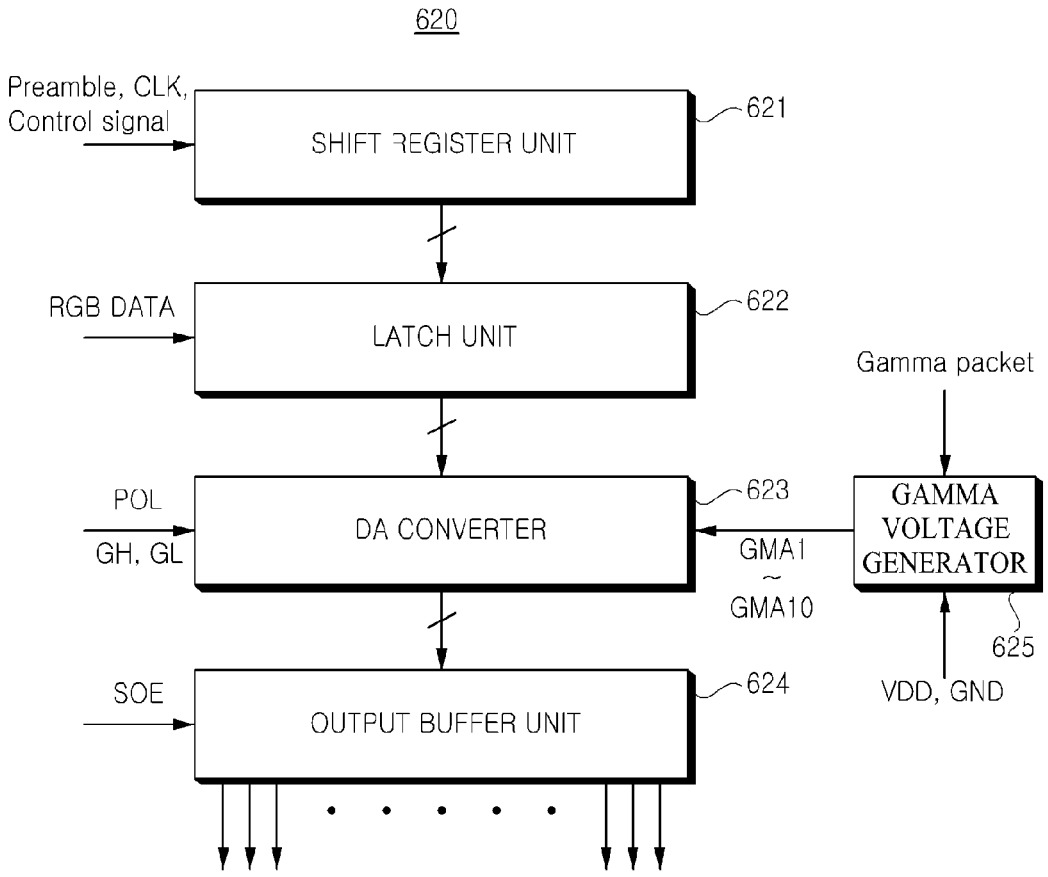
FIG. 6 is a diagram illustrating a data driver included in the TMIC and a separately provided data driver.

FIG. 6 is a diagram illustrating the data driver included in the TMIC and a separately provided data driver.

Referring to FIG. 6, the data driver 620 included in the TMIC 600 and the data drivers 300 included in the PCB 200 convert digital image data into analog data voltages with gamma voltages GMA, and supplies the analog data voltages to the respective pixels of the liquid crystal panel 100.

The data driver 620 included in the TMIC 600 directly receives digital image data and a control signal from the timing controller 610, converts the digital image data into analog data voltages, and supplies the data voltages to the respective data lines of the liquid crystal panel 100.

The data drivers 300 convert digital image data into analog data voltages on the basis of EPI packets supplied from the TMIC 600, and supply the data voltages to the respective data lines of the liquid crystal panel 100.

Each of the data drivers 620 and 300 includes a shift register unit 621, a latch unit 622, a digital-to-analog (DA) converter 623, an output buffer unit 624, and a gamma voltage generator 625.

The shift register unit 621 generates a sampling signal with an input preamble signal, clock, and control signal, and supplies the sampling signal to the latch unit 622. The shift register unit 621 includes n number of shift registers, which sequentially shift a source start pulse (SSP) to output the sampling signals according to a source sampling clock signal (SSC).

The latch unit 622 sequentially latches digital data and supplies one-line data to the DA converter 623, in response to the sampling signal supplied from the shift register 621. To this end, the latch unit 622 is configured with n number of latches for latching n pieces of digital image data, and each of the n latches has a size corresponding to the number of bits of the digital image data.

The DA converter 623 converts digital image data from the latch unit 622 into analog image data, namely, data voltages and outputs the data voltages to the output buffer unit 624.

The DA converter 623 converts digital data from the latch unit 622 into positive and negative analog data voltages, and outputs the positive and negative analog data voltages. To this end, the DA converter 623 includes a positive (P) decoder (not shown) and a negative (N) decoder (not shown) that are in common connected to the latch unit 622, and a multiplexer (MUX) for selecting an output signal of the P decoder and an output signal of the N decoder.

Figure 7:
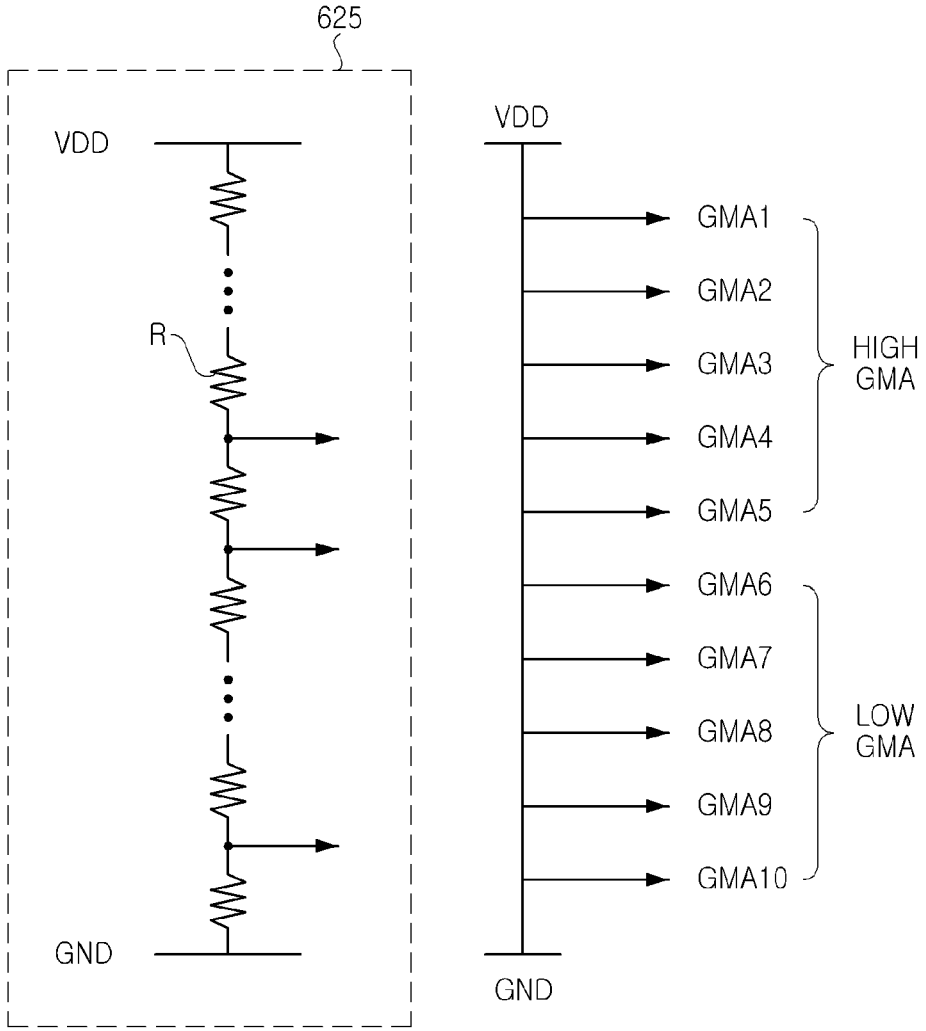
FIG. 7 is a diagram illustrating a gamma voltage generator of the LCD device according to an embodiment of the present invention.

FIG. 7 is a diagram illustrating the gamma voltage generator of the LCD device according to an embodiment of the present invention.

Referring to FIG. 7, the gamma voltage generator 625 generates gamma voltages GMA, which are used to convert digital image data into data voltages, with packet gamma data that are directly supplied from the timing controller 610 or supplied with the packet gamma data being added into an EPIC packet. In this case, the gamma voltages are generated as first to tenth gamma voltages GMA1 to GMA10, and moreover, the generated gamma voltages are supplied to the DA converter 623 and are used to convert digital image data into analog data voltages.

The gamma voltage generator 625 includes a plurality of resistors R that are connected serially between a driving voltage VDD terminal and a ground voltage GND terminal. The resistors are configured in a string, and are connected serially between an input terminal and an output terminal.

Ten levels of first to tenth gamma voltages GMA1 to GMA 10 having different voltage values are generated through respective nodes disposed between the plurality of resistors according to a plurality of resistance values.

Moreover, the gamma voltage generator 625 may further include a plurality of decoders that are connected to the respective nodes between the plurality of resistors, and selectively output one of a plurality of gamma voltages according to an input gamma control signal (gamma packet).

Here, first to fifth gamma voltages GMA1 to GMA5 among the first to tenth gamma voltages GMA1 to GMA10 may be generated as high gamma voltages HIGH GMA for positive (+) data voltages. Also, sixth to tenth gamma voltages GMA6 to GMA10 among the first to tenth gamma voltages GMA1 to GMA10 may be generated as low gamma voltages LOW GMA for negative (−) data voltages.

The gamma voltage generator 625 is disposed inside each of the data drivers 620 and 300, and thereby, the number of lines formed in the PCB 200 can decrease, thus reducing the area of the PCB 200.

Referring again to FIG. 6, the DA converter 623 converts digital image data into positive data voltages with the positive gamma voltages GMA1 to GMA5 supplied from the gamma voltage generator 625. Also, the DA converter 623 converts digital image data into negative data voltages with the negative gamma voltages GMA6 to GMA10 supplied from the gamma voltage generator 625.

The output buffer unit 624 is connected to the data lines formed in the liquid crystal panel 100, and outputs data voltages to the respective data lines.

The output buffer unit 624 includes n number of output buffers, which are respectively configured with a plurality of voltage followers serially connected to the respective n data lines. The output buffers signal-buffer analog data from the DA converter 623 and supply the buffered analog data to the respective data lines formed in the liquid crystal panel 100.

Here, the data driver 610 included in the TMIC 600 and the data drivers 300 mounted on the PCB 200 supply data voltages to the respective n data lines formed in the liquid crystal panel 100 in units of a group including some of the n data lines.

For example, when the TMIC 600 and the two data drivers 300 are mounted on the PCB 200, three data drivers are included in one LCM, and the n data lines are divided into three group and receive data voltages.

Figure 8:
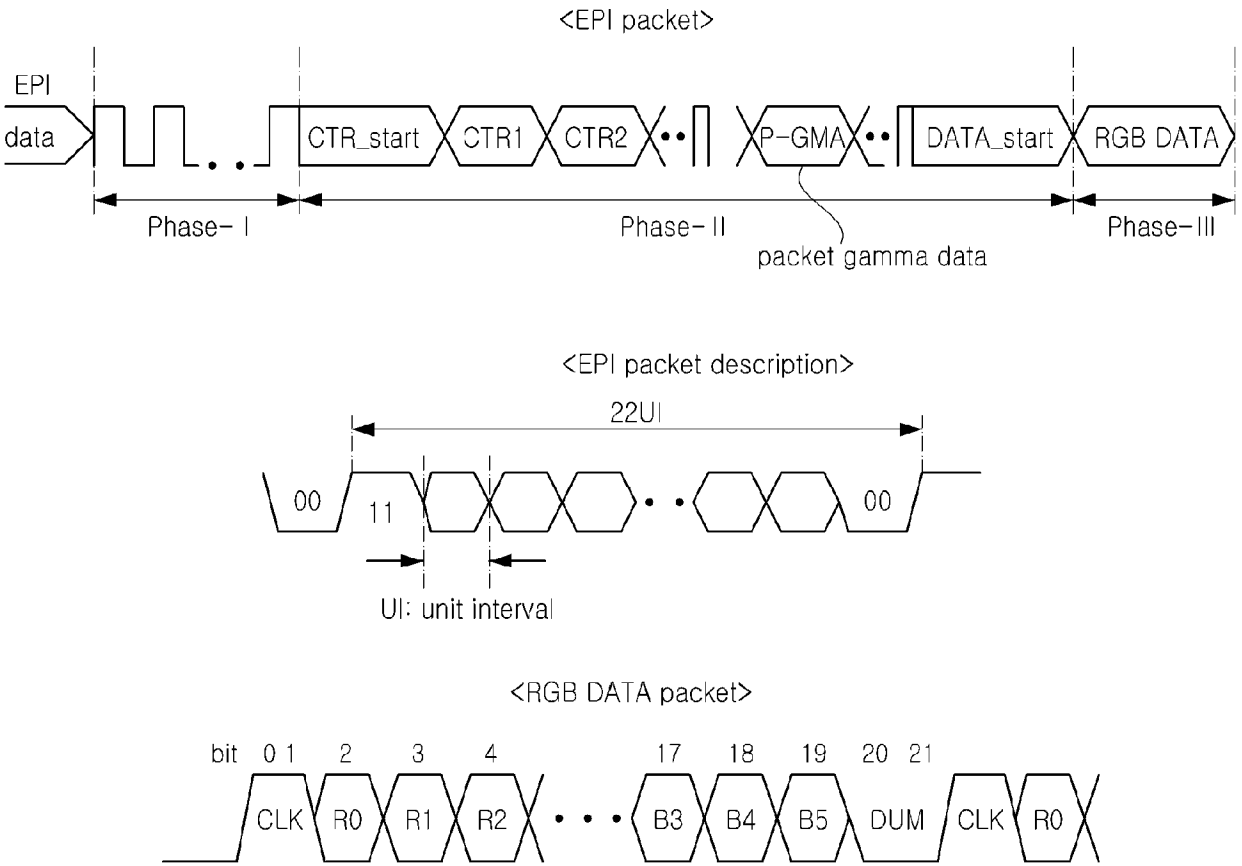

FIGS. 8 and 9 are for describing a driving method according to an embodiment of the present invention, and are diagrams illustrating an EPI packet transferred from the TMIC to the data driver. FIG. 10 is a diagram illustrating packet gamma data applied to the driving method according to an embodiment of the present invention.

Hereinafter, an EPI packet and packet gamma data transferred from the TMIC to the data driver will be described in detail with reference to FIGS. 8 to 10.

An EPI packet is generated by the timing controller 610, and is supplied to the data drivers 300 through the EPI output unit 630. The EPI packet includes a control signal for controlling each of the data drivers 300, packet gamma data for generating gamma voltages, and RGB image data.

The timing controller 610 of the TMIC 600 aligns digital image data inputted from the outside, and configures the digital image data into RGB-DATA packet to add the digital image data into an EPI packet. Furthermore, the timing controller 610 supplies the EPI packet to each of the data drivers 300 (mounted on the PCB 200) through the second lines (EPI packet lines) 220.

The timing controller 610 of the TMIC 600 loads gamma control data stored in the EEPROM 700, generates packet gamma data for generating gamma voltages, and adds the packet gamma data into an EPI packet. The timing controller 610 supplies the EPI packet including the packet gamma data to the data drivers 300 through the second lines (EPI packet lines) 220.

The EPI packet is composed of a plurality of packets, each of which may have a certain number of bits, for example, a 22-bit size.

The packets includes a preamble packet, a control start packet "CTR_START", a plurality of control packets "CTR1 and CTR2", packet gamma data, a data start packet "DATA_START", and an image data packet "RGB_DATA". The packets configures one EPI packet.

Here, the packet gamma data is a control signal for the first to tenth gamma voltages GMA1 to GMA10 that are used for the data drivers 610 and 300 to convert digital image data into analog data voltages.

A plurality of control signals include a preamble signal for initializing the TMIC 600, a clock "CLK", an EPI packet start indication signal "CTR_START", a data enables signal "DE", a source output enable signal "SOE", a source output width signal "SOE width", a polarity signal "POL", a gate start pulse signal "GSP", gamma buffer enable signals "GMAENB1 and GMAENB2", an image data start signal "DATA_START", and packet gamma data.

The preamble signal is encoded into a preamble packet, and the other control signals are encoded into the plurality of control packets "CTR1 and CTR2" and supplied to the data drivers 300.

A gamma control signal for generating the first to tenth gamma voltages GMA1 to GMA10 generated by the data drivers 300 is encoded into separate packet gamma data and thereby added into an EPI packet. In this way, packet gamma data for generating the first to tenth gamma voltages GMA1 to GMA10 may be added into the EPI packet and supplied to the data drivers 300.

The image data include RGB image data, which are serially encoded into a 22-bit RGB_DATA packet and supplied to the data drivers 300.

In the LCD device according to an embodiment of the present invention, by mounting the single TMIC 600 and the two data drivers 300 on PCB 200, the manufacturing cost can be saved compared to the related art LCD device in which a plurality of TMICs are mounted on a PCB.

Specifically, the related art LCD device uses three LVDS-type TMICs for driving a 15.6 inches screen, but, by using the single TMIC 600 and the two data drivers 300, the present invention can decrease the cost of all driving ICs by 11.7% compared to the related art LCD device.

A build-up PCB is a PCB in which, by applying technology that forms various fine holes, a via hole connects layers, and multi layers are formed by processing an array of layers. Although the build-up PCB is expensive, the build-up PCB is inevitably used for forming a plurality of lines in a limited PCB area. On the other hand, an MLB PCB is a PCB in which an internal circuit layer is formed and then layers are stacked, and can be manufactured at the cost lower by 50% than the build-up PCB.

According to the embodiments of the present invention, by the single TMIC 600 on the PCB 200, the number of lines for supplying the LVDSs can be reduced. Accordingly, by replacing the expensive build-up PCB (on which a driving circuit part is mounted) with the inexpensive MLB PCB, the manufacturing cost can be saved.

In the LCD device according to the embodiments of the present invention, by applying the plurality of data drivers and the one TMIC instead of a plurality of TMICs, the manufacturing cost can be saved.

In the LCD device according to the embodiments of the present invention, by replacing the expensive build-up PCB (on which the driving circuit part is mounted) with the inexpensive MLB PCB, the manufacturing cost can be saved.

In the LCD device according to the embodiments of the present invention, the area of the PCB with the driving circuit part mounted thereon can decrease.

In the LCD device according to the embodiments of the present invention, the number of lines that supply the LVDSs to the TMIC mounted on the PCB can be reduced.

In the LCD device according to the embodiments of the present invention, by mounting the gamma voltage generator on the data driver, the manufacturing cost can be saved.

In addition to the aforesaid features and effects of the present invention, other features and effects of the present invention can be newly construed from the embodiments of the present invention.

What is claimed is:

1. A liquid crystal display (LCD) device, comprising:

a liquid crystal panel;

a gate driver provided in an inactive area of the liquid crystal panel; and a printed circuit board (PCB) including:

a connector configured to receive low voltage differential signals (LVDSs) including image signals and a control signal, a timing controller merged integrated circuit (TMIC) including a timing controller and a first data driver, wherein the timing controller and the first data driver are merged within the TMIC, a plurality of second data drivers that are driven with packet data supplied from the TMIC, a power supply connected to the TMIC and the plurality of second data drivers, an erasable programmable read-only memory (EEPROM) to store a control signal for driving the TMIC and controlling gamma voltages, first lines connected between the timing controller of the TMIC and the connector in the PCB, and second lines independently connected between each of the plurality of second data drivers and the timing controller of the TMIC in the PCB, wherein the connector, the TMIC, the power supply, the EEPROM, the first lines, the second lines, and the plurality of second data drivers are mounted on the PCB, wherein the TMIC is configured to convert the image signals and the control signal in the LVDSs received via the first lines into the packet data and output the packet data to the plurality of second data drivers via the second lines, wherein the packet data includes a control signal for controlling each of the plurality of second data drivers, packet gamma data for generating the gamma voltages, and RGB image data, and wherein the PCB is a multi-layer board (MLB) PCB including the first lines and the second lines.

2. The LCD device of claim 1, wherein the TMIC transfers the packet data to the plurality of second data drivers in an EPI type, an AVDS interface type, an ACDS interface type, an RSDS interface type, a TTL interface type, or an eRVDS interface type.

3. The LCD device of claim 1, wherein the packet data is transferred to the plurality of second data drivers in EPI packets generated by the TMIC, via the second lines.

4. The LCD device of claim 1, wherein the TMIC comprises an output unit outputting the packet data to the plurality of second data drivers.

5. The LCD device of claim 1, wherein, the image signal and the control signal are inputted to the TMIC in an LVDS interface type, an AiPi type, an MIPI type, or an eDP interface type, and the TMIC converts an input image and an input control signal into a packet based on an EPI type, an AVDS interface type, an ACDS interface type, an RSDS interface type, a TTL interface type, or an eRVDS interface type, and supplies the packet to the plurality of second data drivers.

6. The LCD device of claim 1, wherein the first data driver in the TMIC and the plurality of second data drivers mounted on the PCB each include a gamma voltage generator.

7. The apparatus of claim 1, wherein the first data driver is configured to directly receive the image data, the control signal and a gamma data from the timing controller, convert the image data into data voltages, and supply the data voltages to date lines of a liquid crystal panel.

8. A method of driving a liquid crystal display (LCD) device in which a connector, a single timing controller merged integrated circuit (TMIC) and a plurality of first data drivers are mounted on a printed circuit board (PCB), the method comprising:

storing a control signal for driving the TMIC and controlling gamma voltages in an EEPROM;

inputting an image signal and a control signal received at the connector to the TMIC in an LVDS interface type, via first lines in the PCB;

generating, by a second data driver merged within the TMIC, a data voltage supplied to a liquid crystal panel on the basis of the image signal and the control signal;

converting, by a timing control merged within the TMIC, the image signal and the control signal into packet data, and adding packet gamma data into the packet data for controlling the plurality of first data drivers; supplying the packet data to the plurality of first data drivers, via second lines in the PCB; and generating a data voltage supplied to the liquid crystal panel on the basis of the packet data inputted from the plurality of first data drivers, wherein the connector is connected to the TMIC via the first lines in the PCB, wherein the TMIC is independently connected to each of the plurality of first data drivers via the second lines in the PCB, wherein the packet data includes a control signal for controlling each of the plurality of first data drivers, the packet gamma data, and RGB image data, and wherein the PCB is a multi-layer board (MLB) PCB including the first lines and the second lines.

9. The method of claim 8, wherein the TMIC transfers the packet data to the plurality of first data drivers in an EPI type, an AVDS interface type, an ACDS interface type, an RSDS interface type, a TTL interface type, or an eRVDS interface type.

10. The method of claim 8, wherein the second data driver in the TMIC and the plurality of first data drivers mounted on the PCB each include a gamma voltage generator.

11. The apparatus of claim 8, wherein the TMIC comprises a timing controller and the second data driver, and wherein the timing controller and the second data driver are merged within the TMIC.

12. The apparatus of claim 11, wherein the second data driver is configured to directly receive the image data, the control signal and a gamma data from the timing controller, convert the image data into data voltages, and supply the data voltages to date lines of a liquid crystal panel.

13. An apparatus comprising:

an integrated circuit configured to receive an image data and a control signal as low voltage differential signals (LVDSs) through a plurality of first lines connected to a connector and to generate an embedded point-to-point interface (EPI) packet; and an erasable programmable read-only memory (EEPROM) disposed in a printed circuit board (PCB) configured to store a control data for driving the integrated circuit and generating gamma voltages, wherein the integrated circuit comprises:

a timing controller configured to convert the image data and the control signal into the embedded point-to-point interface (EPI) packet;

a first data driver configured to directly receive the image data, the control signal and a gamma data from the timing controller, convert the image data into data voltages, and supply the data voltages to a liquid crystal panel; and an EPI output unit configured to supply the embedded point-to-point interface (EPI) packet to a plurality of second lines connected to a plurality of second data drivers, wherein the connector is connected to the integrated circuit via the plurality of first lines in the PCB, wherein the integrated circuit is independently connected to the plurality of second data drivers via the plurality second lines in the PCB, wherein the embedded point-to-point interface (EPI) packet includes a control signal for controlling each of the plurality of second data drivers, packet gamma data for generating the gamma voltages, and RGB image data, and wherein the PCB is a multi-layer board (MLB) PCB including the first lines and the second lines.

* * * * *